US006597635B2

(12) United States Patent
Dalloz

(10) Patent No.: US 6,597,635 B2
(45) Date of Patent: Jul. 22, 2003

(54) TIMEPIECE

(75) Inventor: Jean-Pierre Dalloz, Lavans-les-St-Claude (FR)

(73) Assignee: Daniel Roth & Gerald Genta Haute Horlogerie SA, Geneva (CH)

( * ) Notice: Subject to any disclaimer, the term of this patent is extended or adjusted under 35 U.S.C. 154(b) by 0 days.

(21) Appl. No.: 10/350,595

(22) Filed: Jan. 24, 2003

(65) Prior Publication Data

US 2003/0112706 A1 Jun. 19, 2003

Related U.S. Application Data

(63) Continuation of application No. PCT/IB01/01338, filed on Jul. 26, 2001.

(30) Foreign Application Priority Data

Jul. 31, 2002 (EP) ..... 00810690

(51) Int. Cl.[7] ..... G04B 19/22
(52) U.S. Cl. ..... 368/21; 368/27
(58) Field of Search ..... 368/21, 22, 27, 368/80, 223

(56) References Cited

U.S. PATENT DOCUMENTS 4,998,230 A * 3/1991 Fini ..... 368/27
5,745,440 A * 4/1998 Chen ..... 368/27

FOREIGN PATENT DOCUMENTS

| | | |
|---|---|---|
| CH | 285 848 | 9/1952 |
| DE | 873 521 | 4/1953 |
| FR | 2752628 * | 6/1997 |

* cited by examiner

*Primary Examiner*—Vit Miska
(74) *Attorney, Agent, or Firm*—Sturm & Fix LLP

(57) ABSTRACT

A toothed correcting gear (33, 34), in engagement with means of angular positioning (35), kinematically links the stepwise, drive members (14, 15) of the display members with a time zones indicator gear (19, 20), toothing (34) of the said correcting gear being in engagement with a drive finger (36*a*) of a correcting rocker (36), in the position of rest of this rocker, corresponding to the relaxing of its restoring spring (37), the trajectory described by this rocker (36), for bringing it into its other limit position, passing via one of the teeth of the said correcting gear (34), this trajectory being chosen so that this tooth is reset into its initial angular position once this rocker (36) has moved into its other limit position, the return of this rocker to its position of rest via the relaxing of the said restoring spring, causing the driving by one step of the said toothing of the said correcting gear (34) by the said drive finger (36*a*).

8 Claims, 8 Drawing Sheets

TIMEPIECE

This is a continuation of PCT/IB01/01338 filed Jul. 26, 2001.

The present invention relates to a timepiece comprising a 0 to 12 hours display, a minutes display, a time zone display for two geographical locations situated in two time zones separated by 180° from one another, corresponding to the hours displayed by the said hours display, an AM/PM display for distinguishing between the hours preceding and those following the crossing of the meridian by the sun, an indicator for indicating for which of the two time zones displayed the hours are those before or after the crossing of the meridian, stepwise drive members for the moving elements of the said hour display and AM/PM indications and a rocker for the simultaneous correction of the hour display, time zone display and AM/PM indicator, capable of moving between two limit positions, and held in one of the said limit positions by a restoring spring.

There are several sorts of mechanisms for selectively displaying the time as a function of the time zone in which one finds oneself. Thus, FR 2 752 628 relates to a watch of this type in which the hours are displayed both by a hand and by a disc which indicates the local hours corresponding to those of the various cities, on a 24-hour scale. The cities representative of the various time zones are borne by a rotary disc. A correcting mechanism, intended for going from one time zone to another, links the 24-hour disc, the time zone disc bearing the indication of the cities and the time signalling in such a way as to make the cities disc and the hours disc perform $1/24^{th}$ of a revolution with each correction.

Such a system makes it possible to ascertain the local time of the various locations on the planet by looking at the 24-hour disc and the corresponding cities. One of the drawbacks of such a mode of display arises from the fact that in most of the countries of the world, especially in all English-speaking countries, people are not accustomed to counting the hours of the day over 24 hours. Even in other countries, generally, the common parlance is to speak more easily of 2 PM rather than 14 hours for example, so that a watch displaying the hours on a 24-hour scale does not give a universally standard indication, even if it is comprehensible.

Another drawback arises from the fact that with a division into 24 time zones, the angular space is only 15°, so that in the case of a wristwatch, the indications of the cities belonging to the respective time zones is extremely constricted and consequently the indications must be written in very small characters and are therefore difficult to read.

However, the major drawback of the known systems arises essentially from the correcting mechanism. Specifically, when changing time zone, it is necessary to press a correcting pusher to move the hours indication and the time zone indication. The cinematic link in the known mechanisms is obtained through wheels and levers. The correction results directly from the pressure exerted on the correcting pusher controlling a rocker designed to drive the entire cinematic chain intended for the simultaneous correction of two indicators, that for the hour and that for the time zone.

In actuating conditions which are certainly incorrect but nevertheless possible, it may happen that just one of the two indicators is corrected, then inducing an error in the display of the time in the time zones as a whole. If such an error occurs, it is not then possible to correct it via the time zone correcting pusher. One is then compelled to correct it via the winding and time-setting stem, so losing the advantages of fast correction by pusher. This error results in fact from incomplete pressing of the correcting pusher. Specifically, the correction resulting directly from the travel of the pusher, it is always possible that now and again a user may not exert sufficient pressure for the simultaneous correction to occur. Even if this risk is small, it has an adverse consequence in so far as it cannot be corrected other than via the winding stem.

The aim of the present invention is to remedy, at least partly, the abovementioned drawbacks.

Accordingly, the subject of the present invention is a timepiece of the abovementioned type, as defined by claim 1.

The essential advantage of the solution proposed by this invention lies in the fact that the correction does not result directly from the pressure exerted on the correcting pusher, but that it is produced via the tightening of the restoring spring and only if this tightening is complete, that is to say if the finger of the correcting rocker is dislodged from the toothing, in which it is engaged, of the stepwise drive member for driving the moving elements of the display, going past a tooth of this toothing. If the pressure on the pusher is incomplete and if the finger of the rocker does not go past the tooth of the toothing of this member for the stepwise driving of the moveable elements of the display, the restoring spring relaxes without driving the drive member and without any correction occurring. In this case, the user will immediately realize that no correction has been made and he will merely need to press the pusher further down in order for the correction to be made. Therefore, no accidental offset between the display of the time and the indication of the time zone can occur following the actuation of the correcting pusher. Another advantage arises from the fact that the hours are displayed on a twelve-hour scale and two time zones 180° apart are displayed simultaneously, the AM/PM display and the indicator showing the zone to which these AM/PM indications relate, makes it possible to avoid any error in the reading of the time indications without having to resort to a 24-hour scale.

The description which follows is given with the aid of the appended drawings which illustrate, diagrammatically and by way of example, an embodiment of the mechanism of the timepiece which is the subject of the present invention.

Figure 1:
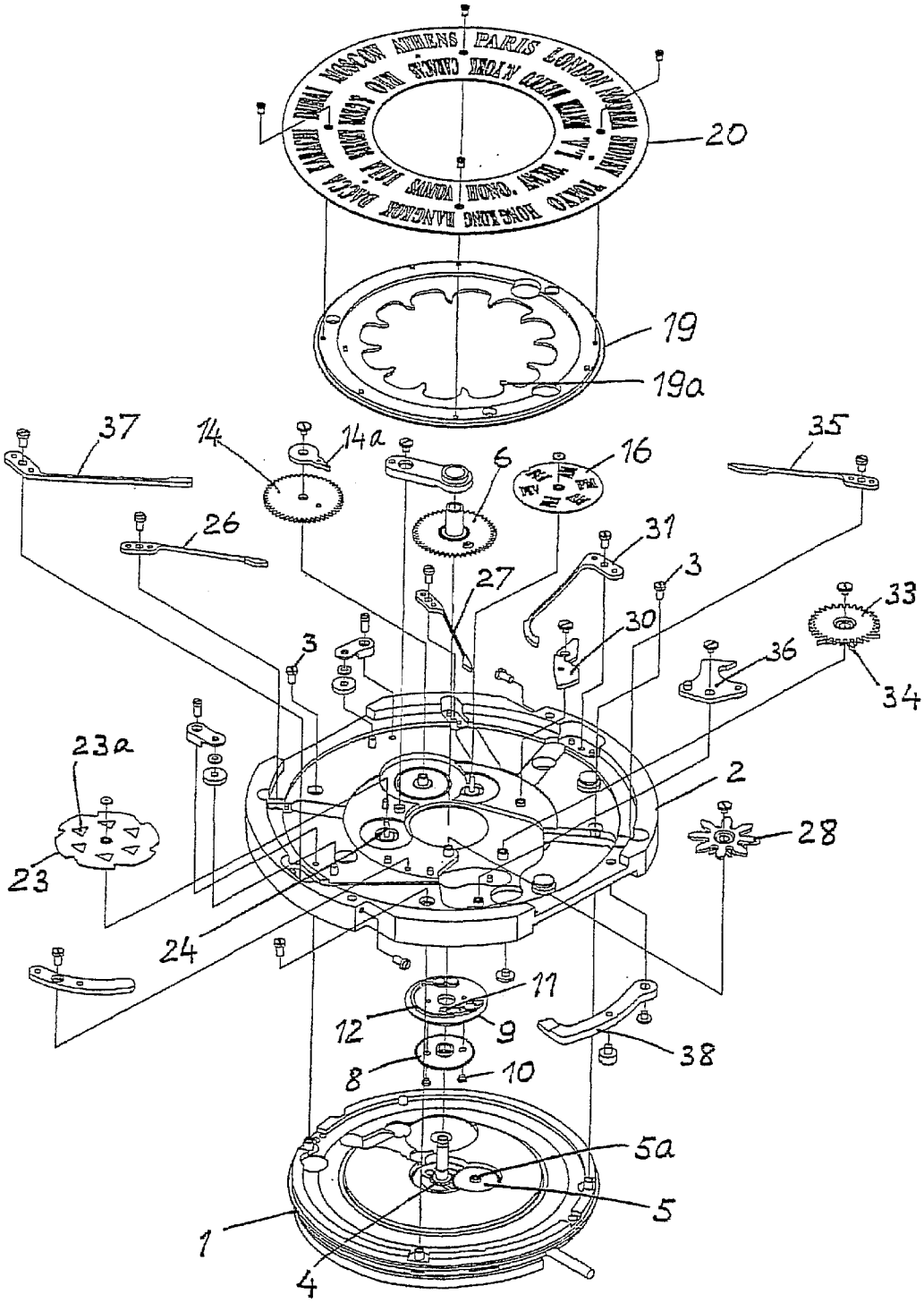
FIG. 1 is an exploded perspective view of the display mechanisms of this embodiment.
Figure 2:
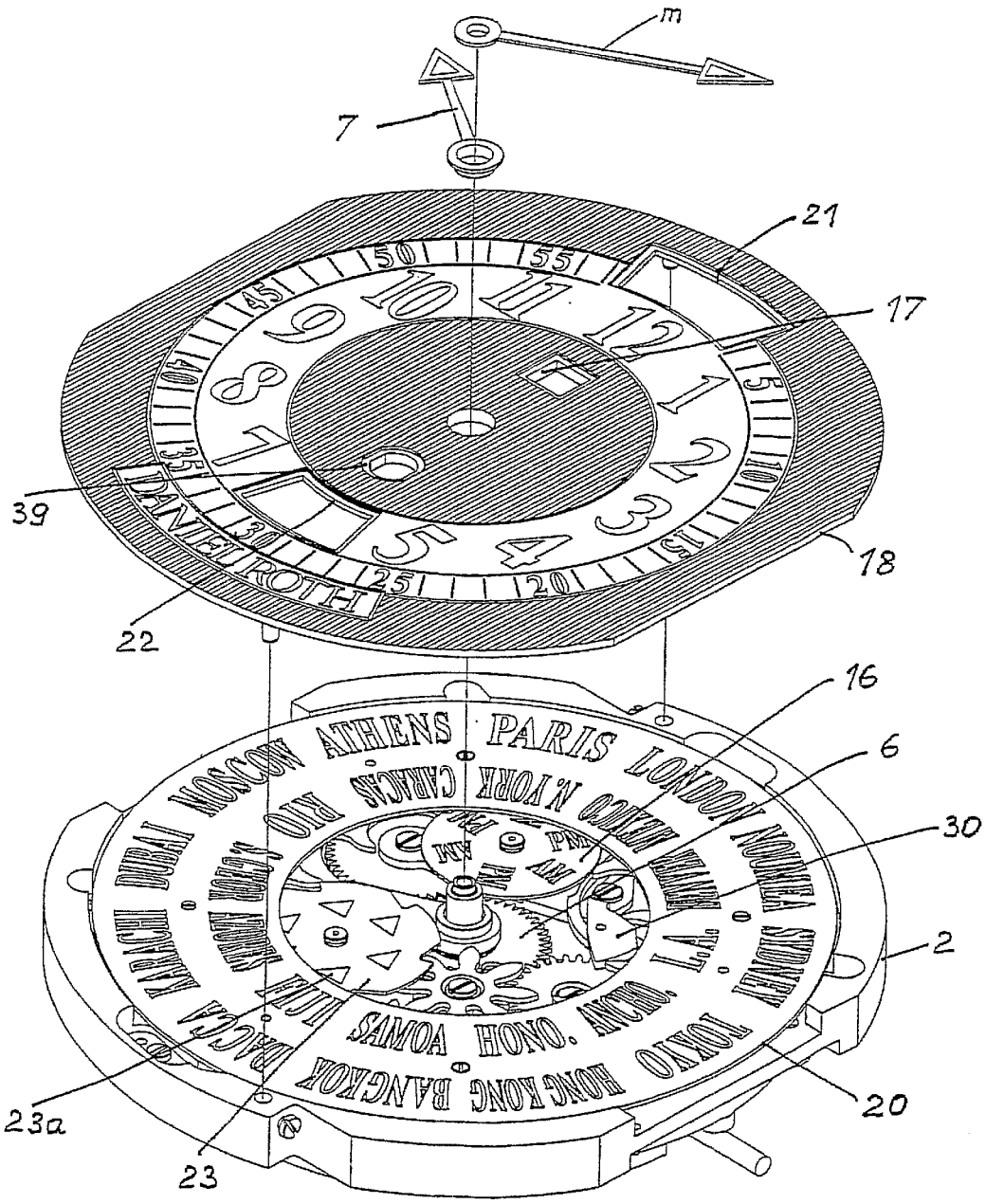
FIG. 2 is an assembled perspective view of the mechanisms of FIG. 1 with the dial and the hands exploded.
Figure 3:
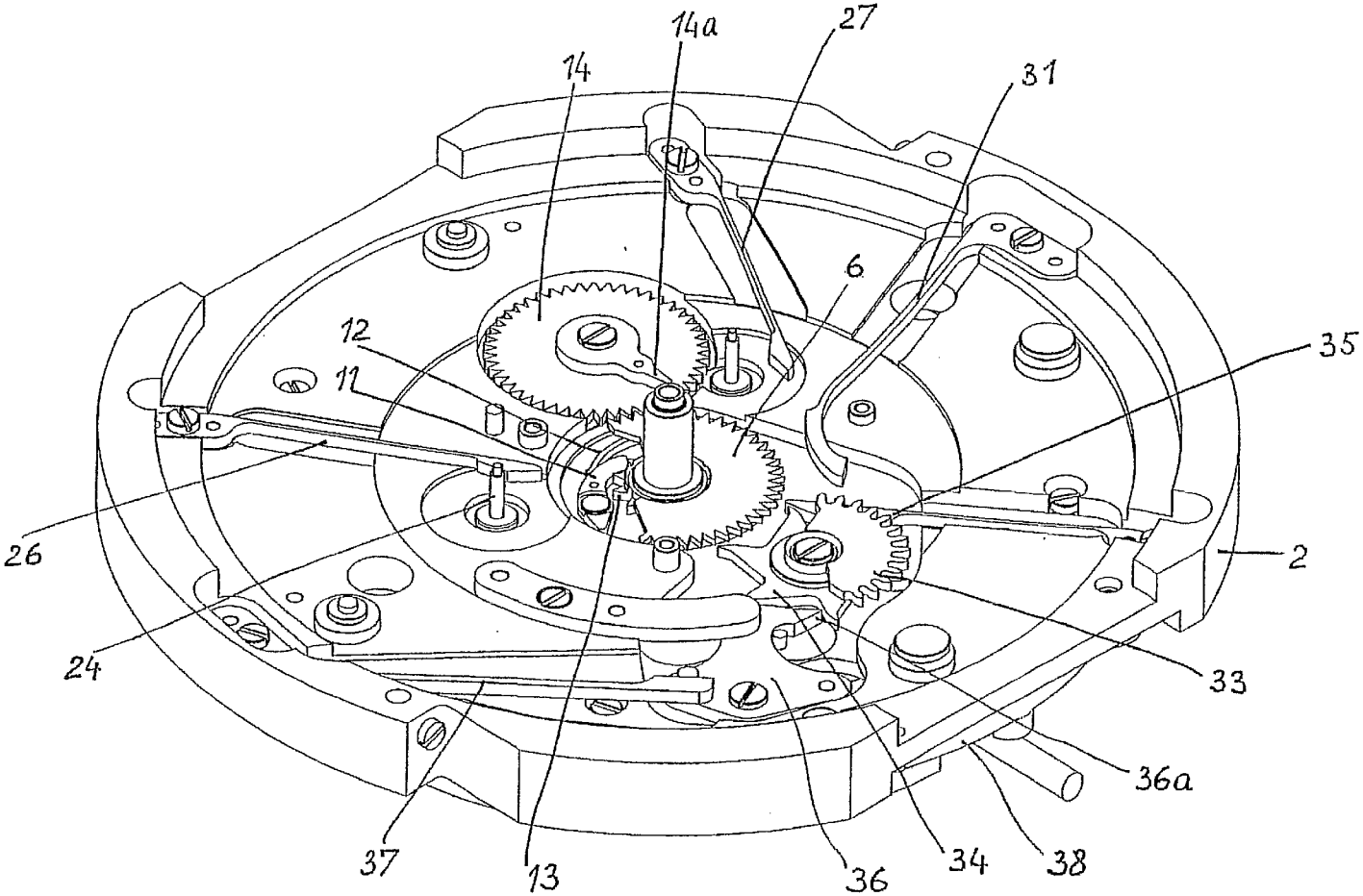
FIG. 3 is a perspective view of the partially assembled display mechanisms with certain parts being cut away.

The timepiece illustrated by FIG. 1 comprises a conventional movement 1 onto which a plate 2 of the universal time display mechanism is attached and held by screws 3. The watch movement 1 has, in the customary manner, a minute train comprising a cannon pinion 4 and a minute wheel 5. The remainder of the watch movement proper is entirely conventional and need not be described, in so far as it does not form part of the invention and is not necessary for the comprehension thereof. The link between the pinion 5*a* of the minute wheel 5 and the hour wheel 6 bearing the hour hand 7 (FIG. 2) is produced by a wheel 8 (FIG. 1) meshing with the pinion 5*a* of the minute wheel 5*a*, on which a disc 9 is fixed by screws 10. This disc 9 bears a pawl 11 pressed by a spring 12 into the star toothing of twelve teeth of a pinion 13 fixed under the hour wheel 6 (FIG. 3). By virtue of this link between the minute train 4, 5 and the hour wheel 6, the latter can be disunited from this train during a change of time zone and regain the angular position which it occupied at the moment of correction, offset by a multiple of 30° after the change of time zone, whereas it is otherwise driven normally by the minute train 4, 5, 5*a*.

As illustrated by FIG. 3, the hour wheel 6 is in engagement with a wheel 14 bearing a drive finger 14*a* intended to come into engagement at each revolution of the wheel 14, that is to say every 12 hours, with a star pinion 15 (FIG. 7) bearing a disc 16 on which are alternately indicated AM/PM (the abbreviation standing for hours respectively before and after the crossing of the meridian by the sun). These indications appear in an aperture 17 of the dial 18 (FIGS. 2, 8–10) and change each twelve hours.

All the indications of the time or derivatives of the time described hitherto are therefore kinematically linked to the standard minute train 4, 5, 5*a* of the watch. They can be modified if need be via the conventional time-setting mechanism (not described or represented here), in an entirely standard manner. The timepiece described furthermore comprises two additional displays, both independent of the minute train 4, 5, 5*a*, but which, during correction of the time zone, must be kinematically tied to the hour hand 7 and to the AM/PM disc 16. This involves an annulus 19 provided with inner toothing 19*a* and on which is fixed an annulus 20 bearing the names of various cities representative of the twenty-four time zones, arranged according to two concentric rings. The diametrically opposed cities of the outer and inner rings appear respectively in two apertures 21, 22 arranged opposite twelve o'clock, respectively at six o'clock on the dial 18 (FIG. 2). The outer cities of the ring which are situated at 180° from a city of the inner ring are in two time zones 180° apart, so that the hours indicated by the hour hand 7 correspond to the hours before the sun crosses the meridian in respect of one of the two cities and to the hours after the crossing of the meridian in respect of the other of these cities. It is furthermore appropriate to mention the presence of a drive peg 19*b* which projects on the surface of the annulus 19 and the function of which will be explained subsequently.

Figure 7:
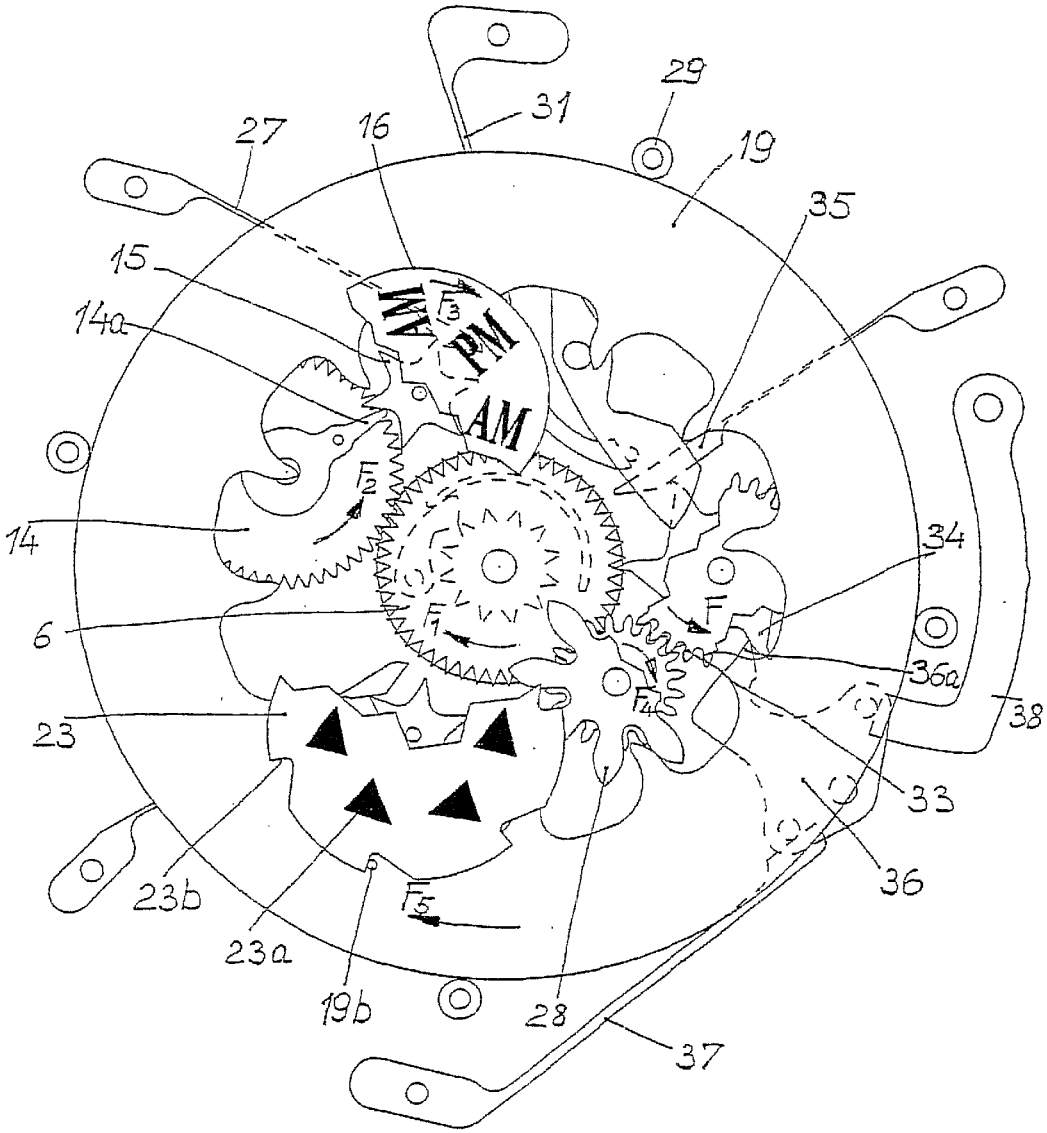

In order to ascertain to which of the two cities the indication AM, PM relates, an indicator consisting of a disc bearing arrows 23*a* is mounted pivotably on a spindle 24. The lower face of this disc is tied to a pinion with star toothing 25 positioned by a jumper 26. Likewise, the star-toothing pinion 15 tied to the disc 16 is positioned by a jumper 27 (FIG. 7).

Figure 4:
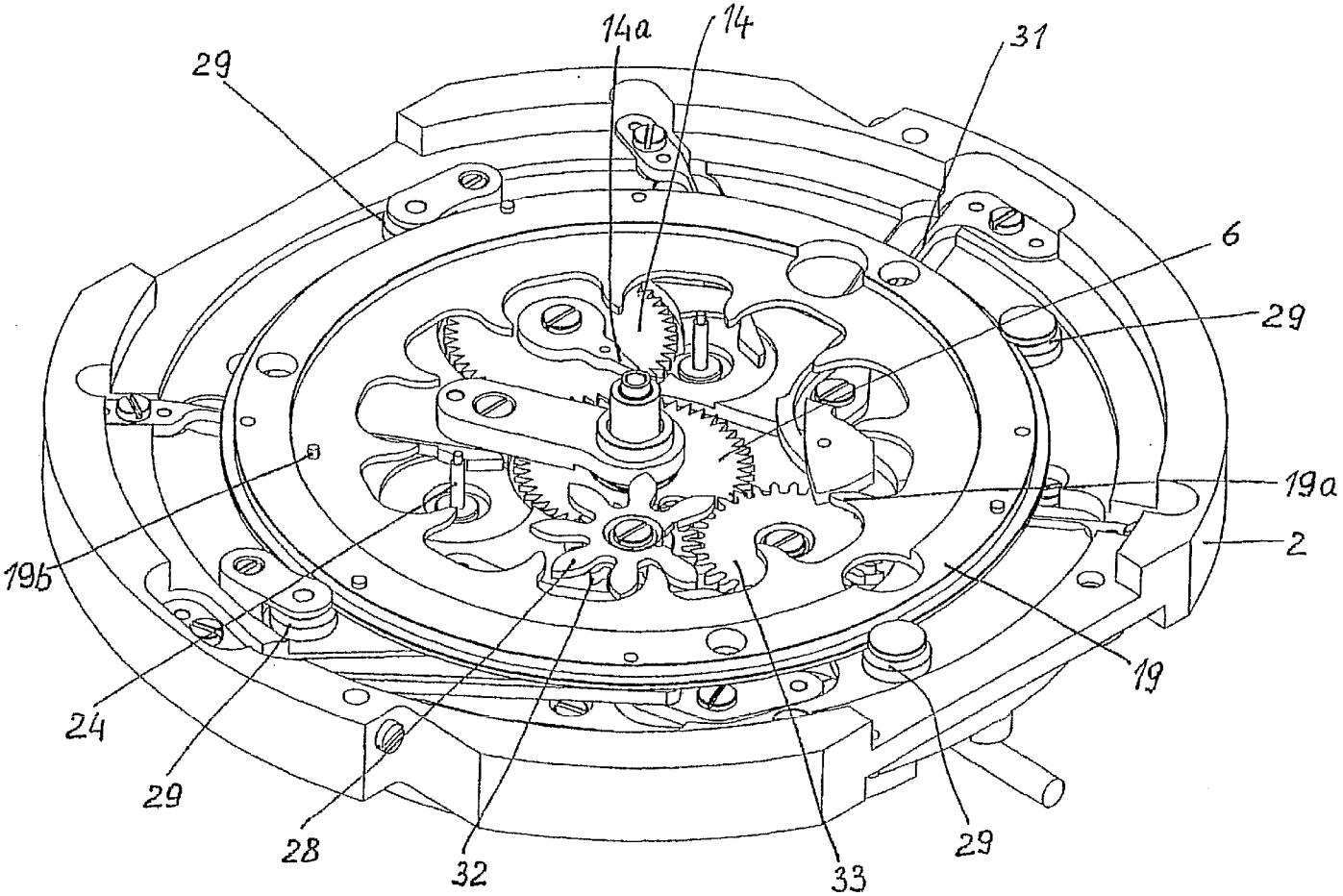
FIG. 4 is another perspective view of the partially assembled display mechanisms with cutaway.

The annulus 19 is guided on the plate 2 by rollers 29 in engagement with its outer edge. The inner toothing 19*a* of this annulus 19 is in engagement with a pinion 28 (FIG. 4) and this toothing 19*a* is positioned by a jumper 30 loaded by a spring 31. The pinion 28 is tied to and concentric with a pinion 32 in engagement with a pinion 33, tied to and concentric with a correcting star 34 (FIGS. 3–7) positioned by a jumper 35. This correcting star 34 is intended to come into engagement with the hour wheel 6. However, as illustrated by FIG. 3 in particular, when it is positioned by the jumper 35, its teeth are outside the trajectory of the toothing of the hour wheel 6, so that the latter can turn freely.

As illustrated by FIG. 3 and FIGS. 5–7, the correcting star 34 is in engagement with a correcting rocker 36 which is in engagement both with a restoring spring 37 and also with an actuating rocker 38 controlled by a pusher (not represented). In the rest position, the correcting rocker 36 occupies the position illustrated by FIG. 5, in which position its drive finger 36*a* (FIGS. 3 and 5) is engaged in the teeth of the correcting star 34.

During normal operation of the watch, the hour hand 7 and minute hand m (FIG. 2) turn normally, respectively making one revolution in twelve hours and in sixty minutes. Each time the hour hand 7 and the hour wheel 6 which carries it make a revolution, the wheel 14 and its drive finger also make a revolution, so that the star pinion 15 carrying the AM/PM disc is driven by one step. The AM or PM indication which appears in the aperture 17 of the dial 18 changes, since these indications alternate on the disc 16. Given that two cities situated in two time zones situated 180° apart are visible in the apertures 21 and 22, the arrows 23*a* appear through an aperture 39 (FIGS. 2, 8–10) indicating to which of the cities displayed in the apertures 21 or 22 the AM or PM indication appearing in the aperture 17 relates.

It is obvious that so long as the time zone does not change, the indications appearing in the apertures 21, 22 and 39 do not change either, only the AM, PM indication changing every twelve hours.

As may be observed by looking at the inscriptions carried by the annulus 20 (FIG. 2), the cities indicated are arranged according to adjacent time zones with the exception of Nouméa followed by London and diametrically opposite, Fiji followed by Azores, which are respectively situated in zones separated by 180°.

Figure 5:
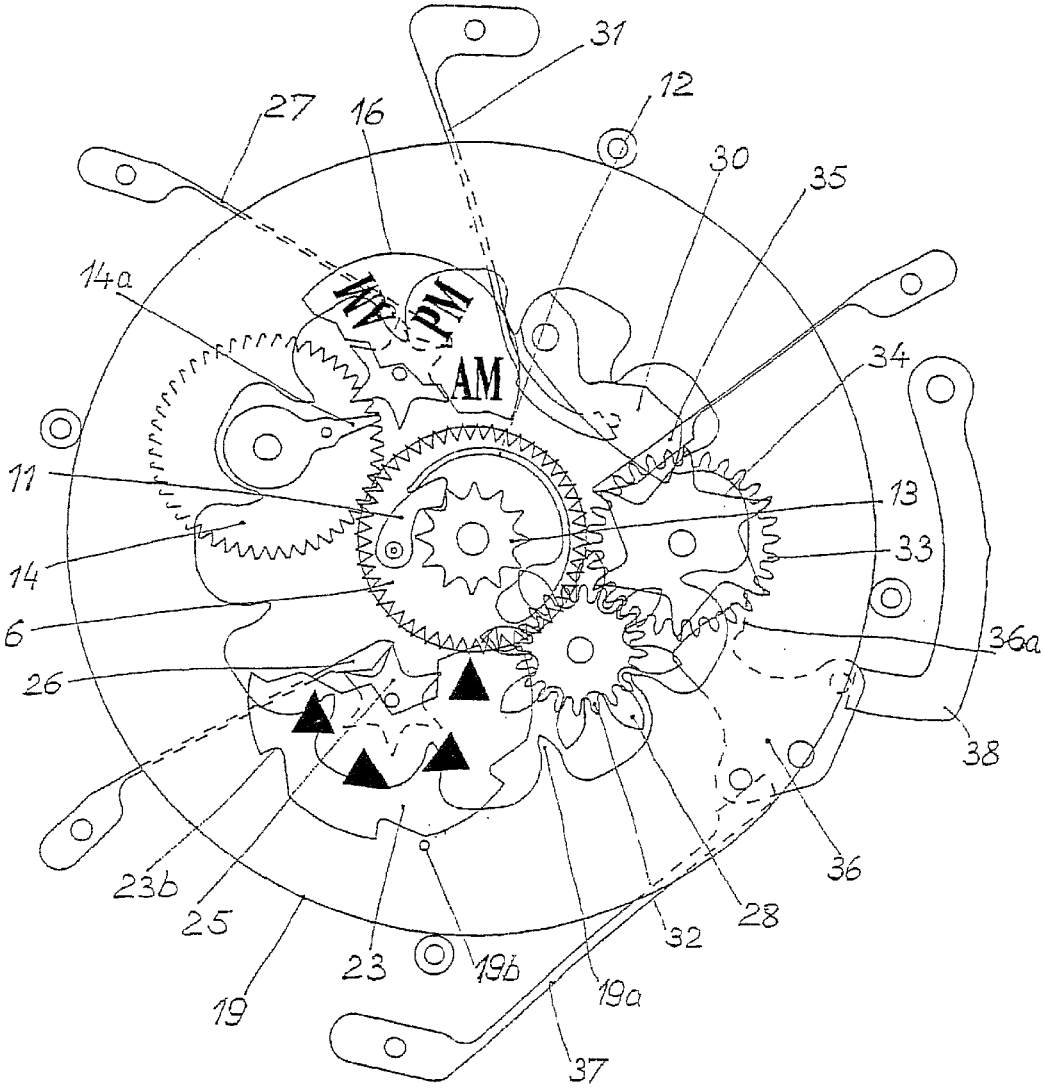
FIGS. 5–7 are partial plan views of the display mechanisms in three phases of the correction procedure.
Figure 6:
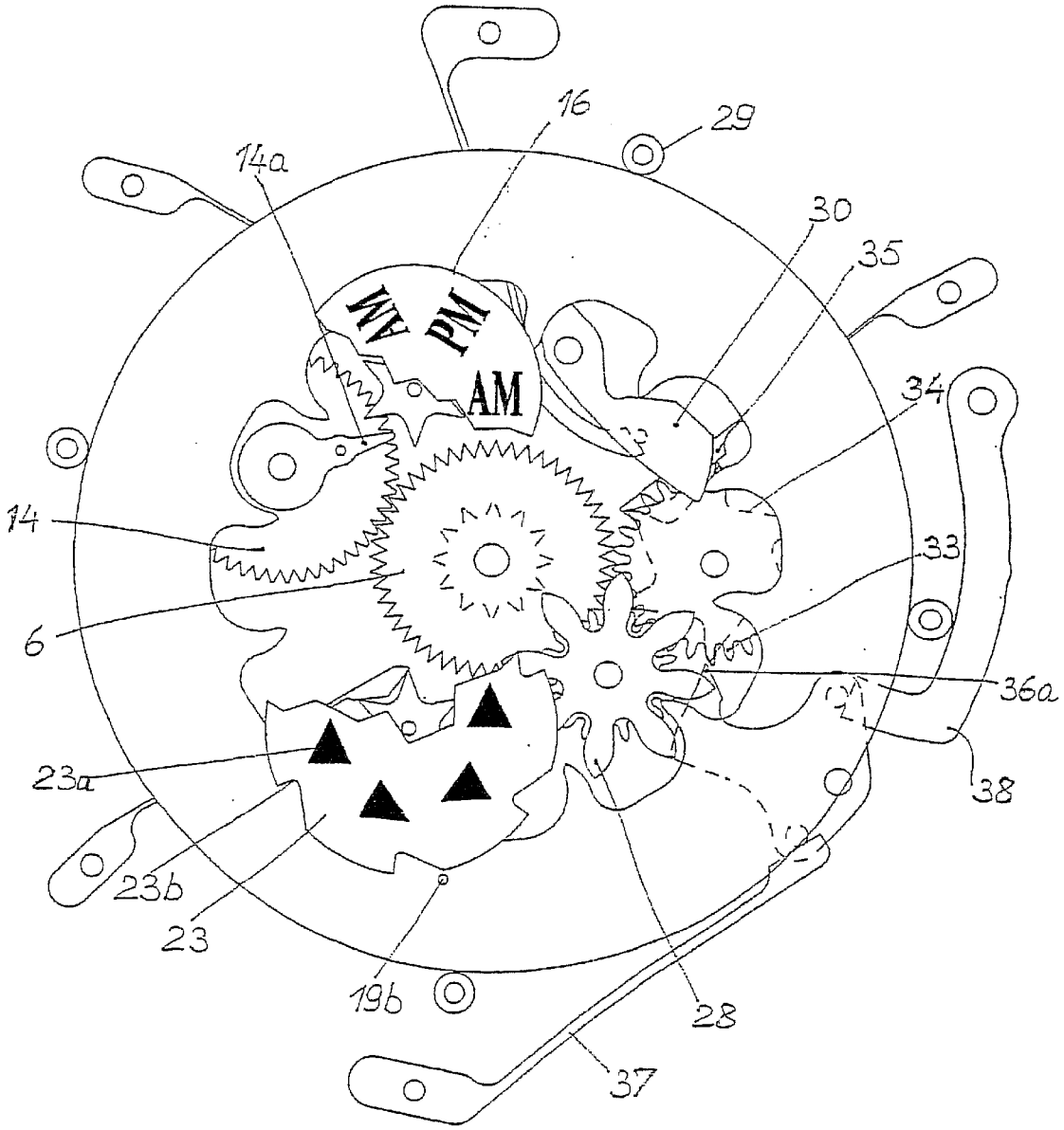
Figure 10:
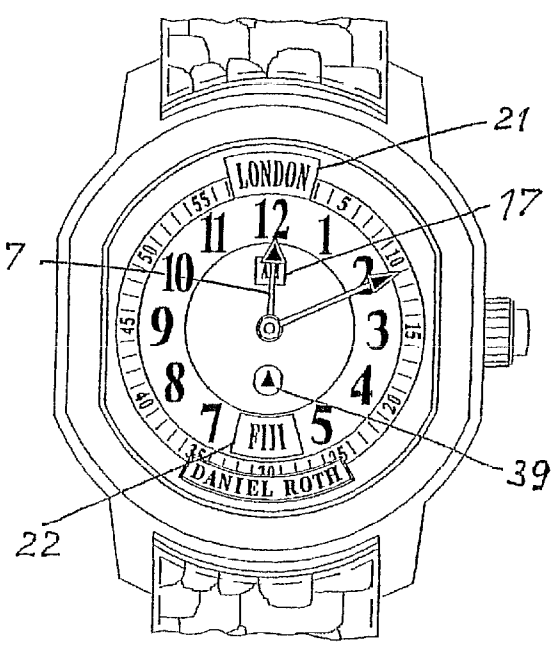
FIGS. 8–10 are plan views of the various displays during the correction phases illustrated by FIGS. 5–7.
Figure 9:
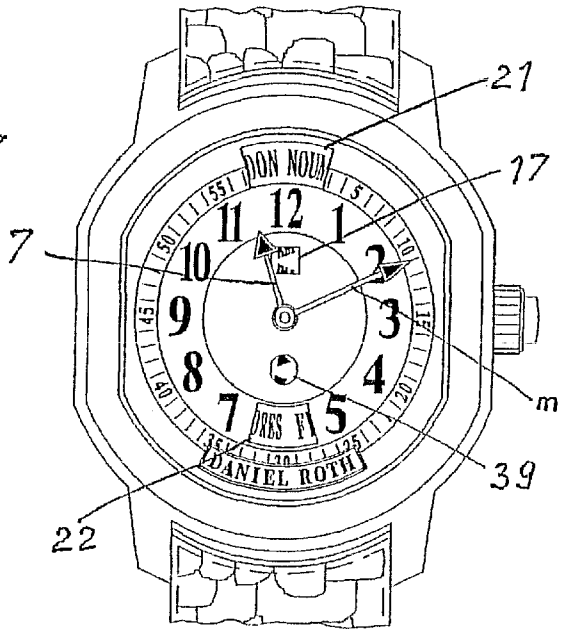
Figure 8:
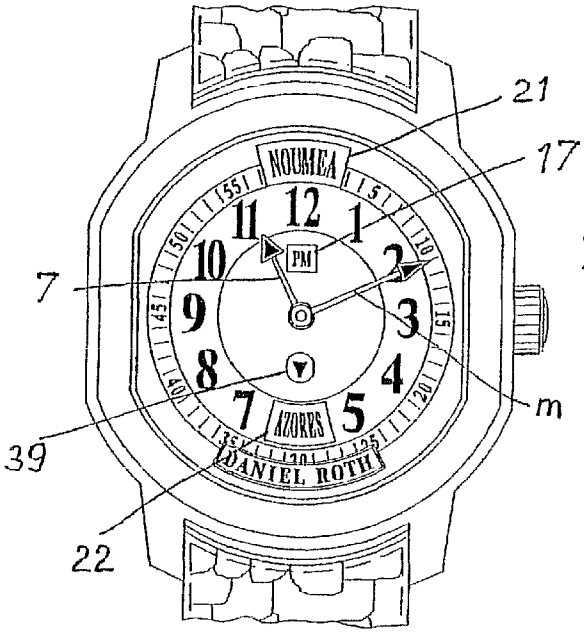

We shall now explain how the crossover between these time zones separated by twelve zones occurs by referring to FIGS. 5–7 and to FIGS. 8–10, which respectively show the positions of the various displays during the correction steps illustrated by FIGS. 5–7.

FIG. 5 shows the mechanism at rest, all the star-toothing pinions 15, 25, 34 and the toothing 19*a* being positioned by the respective jumpers 26, 27, 30 and 35. The indications then appearing in the apertures 17, 21, 22 and 39 being those illustrated by FIG. 8. By pressing on the actuating rocker 38, the correcting rocker 36 is caused to go from its rest position, illustrated by FIG. 5, to a second limit position illustrated by FIG. 6. On going from the position of FIG. 5 to that of FIG. 6, the drive finger 36*a* of the correcting rocker 36 encounters, at the end of its travel, a tooth of the correcting star 34, so that it moves this star 34 slightly by a fraction of its step. After the finger 36*a* passes, the jumper 35 returns the correcting star 34 to its initial position, as may be seen in FIG. 6. During this travel of the correcting rocker 36, the restoring spring 37 is tightened. In FIG. 6 it may be observed that at the end of the travel of the correcting rocker 36, its drive finger 36*a* lies just behind the tooth of the correcting star 34 which this finger moved during its travel from its rest position to its other limit position illustrated by this FIG. 6.

Assuming that the pressure exerted on the actuating rocker 38 is not sufficient to bring the correcting rocker 36 into the position illustrated by FIG. 6, the drive finger 36*a* of this rocker 36 would then lie not behind the tooth of the correcting star 34, as illustrated by FIG. 6, but in front of this tooth. By releasing the pressure exerted on the actuating rocker 28, the restoring spring 37 then returns the correcting rocker 36 into the position illustrated by FIG. 5 without any correction having occurred.

In order that the correction may take place, it is therefore necessary for the correcting rocker 36 to reach the position illustrated by FIG. 6. At this moment, when the actuating rocker 38 is freed, the restoring spring 37 relaxes, driving the correcting rocker 36. The drive finger then moves the correcting star 34 and the coaxial pinion 33 tied thereto by one step of the star 34. FIG. 7 illustrates the mechanism during this movement and FIG. 9 shows the corresponding positions of the various displays.

The correcting star 34 turning by 60° in the direction of the arrow F drives the hour wheel 6 by 30° in the direction of the arrow $F_1$. The wheel 14 which is in a ratio of 1/1 with the hour wheel 6 and its drive finger 14*a* also turns by 30° in the direction of the arrow $F_2$. If this correction is made close to the crossing of the meridian by the sun, the drive finger 14*a* will move the AM/PM disc 16 by one step of the star pinion 15 in the direction of the arrow $F_3$. By virtue of the pawl 11 and the spring 12, the hour wheel 6 can move with respect to the minute train 4, 5, 5*a* (FIG. 1), without moving the minute hand m.

Simultaneously with the correcting of the time, the pinion 33 tied to the correcting star 34 drives the pinion 32. The meshing ratio is chosen so that the pinion 33 moving by 60° in the direction of the arrow F, the pinion 32 moves by 90° in the direction of the arrow $F_4$, so that the pinion 28 drives the toothed annulus 19 by 30° in the direction of the arrow $F_5$.

Given that the change of time zone described here is that which jumps twelve time zones on crossing from the Nouméa zone to the London zone, the peg 19*b* which projects at the surface of the toothed annulus 19 encounters the edge of the disc 23 bearing the arrows 23*a* during this movement of the toothed annulus 19 in the direction of the arrow $F_5$. The edge of this disc 23 has notches 23*b* with which the peg 19*b* can come into engagement with the disc 23 and drive it, so changing the direction of the arrow 23*a* in the aperture 39. As may be seen in FIGS. 8 and 10, the direction of the arrow in the aperture 39 has reversed on crossing from the Nouméa/Azores zone to the London/Fiji zone. This signifies that in FIG. 8, the PM indication referred to Azores, so that at the same instant the Nouméa hours corresponded to the hours before the crossing of the meridian by the sun. Given that going from the Nouméa zone to the London zone involves crossing not one but twelve time zones, the arrow 23*a* appearing in the aperture 39 has reversed indicating that the AM/PM indication for the hours displayed by the hour hand 7 no longer relates to the bottom aperture 22, but the top aperture 21.

It is obvious that this correction of the arrow 23*a* appearing in the aperture 39 occurs only during this crossover corresponding to twelve time zones. The toothed annulus 19 bears nothing besides a peg 19*b* for this purpose. In all other cases, the change corresponds to a change of one hour, so that only the hour hand 7 is moved by 30°. If the hour hand is situated between 11 and 12 o'clock, the AM/PM disc 16 will also be moved, and simultaneously, the toothed annulus 19 and the cities annulus 20 which is tied thereto will move by 30° revealing the indications of cities of two other time zones 180° apart, in the apertures 21, 22.

What is claimed is:

1. Timepiece comprising a 0 to 12 hours display, a minutes display, a time zone display for two geographical locations situated in two time zones separated by 180° from one another, corresponding to the hours displayed by the said hours display, an AM/PM display for distinguishing between the hours preceding and those following the crossing of the meridian by the sun, an indicator for indicating for which of the two time zones displayed the hours are those before or after the crossing of the meridian, stepwise drive members for the moving elements of the said hour display and AM/PM indications and a rocker for the simultaneous correction of the hour display, time zone display and AM/PM indicator, capable of moving between two limit positions, and held in one of the said limit positions by a restoring spring, characterized in that a toothed correcting gear, in engagement with means of angular positioning, kinematically links the said stepwise drive members with a time zone indicator gear, toothing of the said correcting gear being in engagement with a drive finger of the said correcting rocker, in the position of rest of this rocker, corresponding to the relaxing of its restoring spring, the trajectory described by this rocker, for bringing it from this position of rest into its other limit position, passing via one of the teeth of the said correcting gear, this trajectory being chosen so that this tooth is reset into its initial angular position once this rocker has moved into its other limit position, the return of this rocker, from this other limit position to its position of rest via the relaxing of the said restoring spring, causing the driving by one step of the said toothing of the said correcting gear by the said drive finger.

2. Timepiece according to claim 1, wherein the said correcting gear is not in engagement with the said stepwise drive member outside of the time zone changing procedure.

3. Timepiece according to claim 1, wherein the said correcting gear comprises two concentric pinions tied to one another, the one linked kinematically to the said stepwise drive member, the other linked kinematically to the moving member of the said time zone display and to the moving member of the said indicator for indicating for which of the two time zones displayed, the hours are those before or after the crossing of the meridian.

4. Timepiece according to claim 2, wherein the said correcting gear comprises two concentric pinions tied to one another, the one linked kinematically to the said stepwise drive member, the other linked kinematically to the moving member of the said time zone display and to the moving member of the said indicator for indicating for which of the two time zones displayed, the hours are those before or after the crossing of the meridian.

5. Timepiece according to claim 1, wherein the said correcting rocker is actuated by an actuating rocker.

6. Timepiece according to claim 2, wherein the said correcting rocker is actuated by an actuating rocker.

7. Timepiece according to claim 3, wherein the said correcting rocker is actuated by an actuating rocker.

8. Timepiece according to claim 4, wherein the said correcting rocker is actuated by an actuating rocker.

* * * * *